US005353438A

United States Patent [19]

Voiles

[11] Patent Number: 5,353,438

[45] Date of Patent: Oct. 11, 1994

[54] NECKTIE RESTRAINT

[75] Inventor: Reggie Voiles, Great Falls, Mont.

[73] Assignee: Tie-Mate, Inc., Helena, Mont.

[21] Appl. No.: 47,653

[22] Filed: Apr. 12, 1993

[51] Int. Cl.[5] ..... A41F 17/00

[52] U.S. Cl. ..... 2/145; 2/52; 24/49 R; 24/50; 24/49 CF; 24/56

[58] Field of Search ..... 2/52, 144, 145, 146, 2/147, 155, 156, 157; 24/16 PB, 30.5 P, 49 CF, 49 R, 58, 50, 56; 383/71

[56] References Cited

U.S. PATENT DOCUMENTS

| | | | |
|---|---|---|---|
| 2,743,452 | 5/1956 | Waterbury | 2/145 |
| 3,042,983 | 7/1962 | Riedler | 2/145 |
| 3,973,610 | 8/1976 | Ballin | 383/71 |
| 4,835,821 | 6/1989 | Durante | 24/49 CF |
| 4,920,579 | 5/1990 | Swain | 2/145 |
| 5,245,708 | 9/1993 | Campelia | 2/145 |

*Primary Examiner*—Jeanette E. Chapman

[57] ABSTRACT

A device and method for restraining the tail of a necktie to the front of a shirt. The device includes a longitudinal strip of flexible material with a sewn longitudinal button hole on one end and a circular hole on the other.

1 Claim, 1 Drawing Sheet

Figure 1
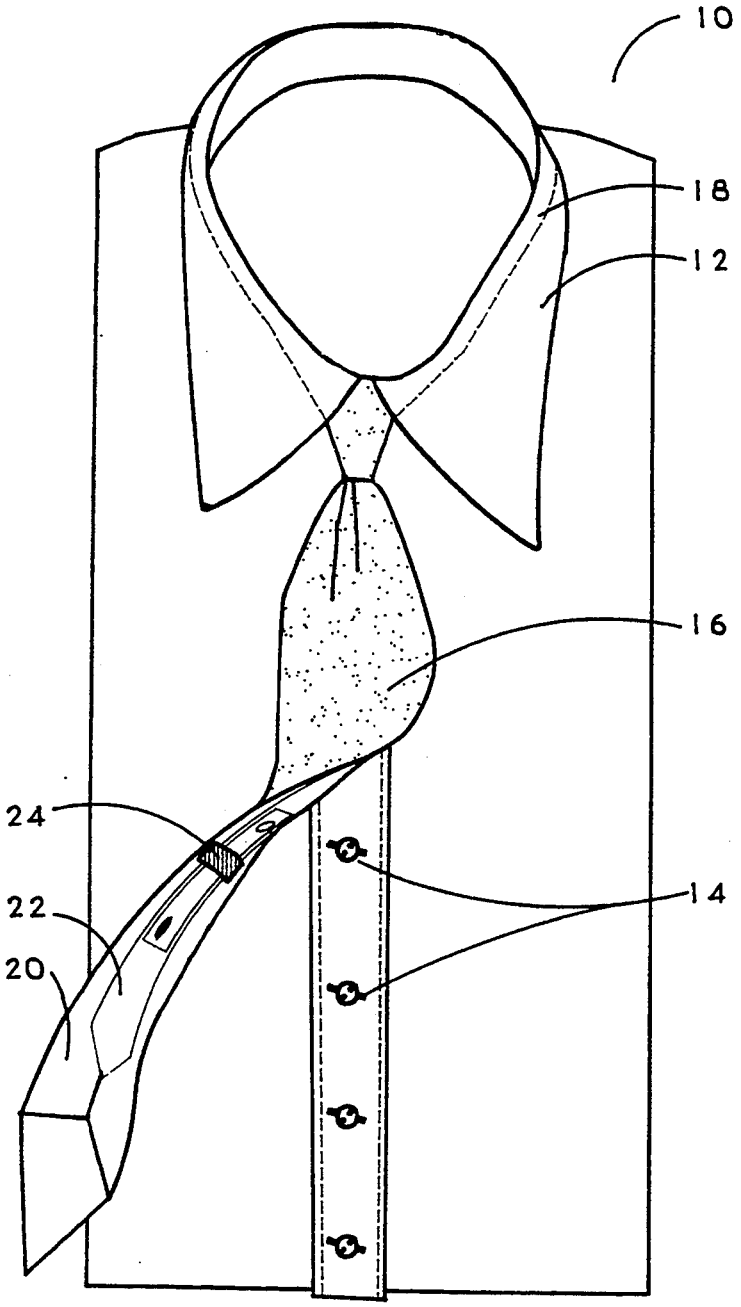
Figure 2
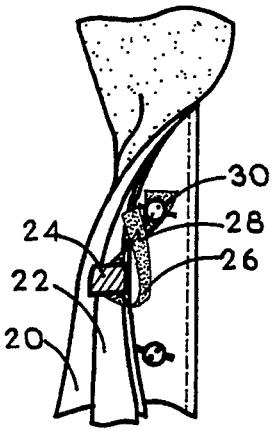
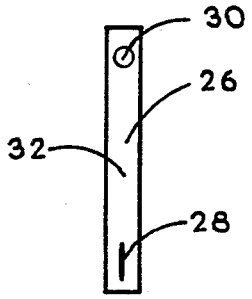
Figure 3

NECKTIE RESTRAINT

BACKGROUND OF THE INVENTION

1. Field of the Invention

This invention relates to a device and method for restraining the tail of a necktie, and more particularly, the invention provides a removable, reusable device for operative engagement with a transverse member such as a sewn in place label extending across the back of the tail of a necktie to constrain and provide limited lateral and parallel movements of the necktie tail while the device is attached to spaced apart buttons on the front of the users shirt.

2. Description of the Prior Art

A typical necktie presents a tie tail which comprises a relatively wide tail portion and a relatively narrow tail portion, that could be held in place at the front of the users shirt or other garment by a tie tack, tie clasp or other article. Over the years, various other devices have been available to secure the necktie tail in place. Typically, such devices require permanent attachment to the necktie or alteration of the necktie, either of which may not be an option of choice to the necktie user. Whereas neckties have evolved from heavier materials to more synthetic blends, advances in manufacture of more traditional necktie fabrics such as silk and cotton have magnified the need for an improved necktie restraint.

Neckties worn underneath a jacket tend to become wrinkled with constant body movement causing the necktie to shift positions and an unsightly bulkiness to develop. On the other hand, when the jacket is removed, the necktie has a tendency to constantly change position in relation to the movement of the wearer. Such movement causes a constant shifting of the position of the necktie and results in an untidy appearance. In operation, the wearer knots the necktie in normal fashion, thereby establishing the positioning of the relatively wide tail portion and the relatively narrow tail portion with respect to each other. It will be understood that the necktie can be knotted in a number of configurations resulting in wide variances in the positioning of the relatively wide and narrow tail portions.

The present invention constitutes an improvement over the previous devices. What was needed was a device and method for restraining the tail portion of a necktie that was inexpensive, simple, removable and reusable.

SUMMARY OF THE INVENTION

1. Objects of the Invention.

It is the object of the present invention to provide a device and method to secure the tail of a typical necktie in a straight line relation down the front of a user shirt while permitting a restricted displacement from this relation by movement of the wearer.

It is a further object of the present invention to provide a device and method to secure the tail of a typical necktie which does not damage nor alter the necktie.

It is a further object of the present invention to provide a device and method for holding a necktie tail in place while being completely hidden from view under normal user movements.

It is another object of the present invention to provide a device for holding a necktie tail in place which is removable and reusable.

It is another object of the present invention to provide a device for holding a necktie tail in place which is inexpensive.

It is another object of the present invention to provide a device for holding a necktie tail in place which utilizes the most proximate button on the users shirt.

It is another object of the present invention to provide a method of securing a necktie tail in place which is simple and easy.

2. Features of the Invention

In keeping with these objects, and others which will become apparent hereinafter, specifically, the present invention provides a removable, reusable device for securing a necktie in place by means of a simple easy to attach one-piece member comprising a longitudinal strip of flexible material, a sewn longitudinal button hole on one end of the longitudinal strip and a circular hole on the other end of the longitudinal strip.

As can be readily inferred from the heretofore stated description of the invention, the method of the invention is directed to a simple, easy method of securing a necktie in place and comprises the steps of knotting a necktie in any suitable well known manner, placing the relatively narrower tail end adjacent to the relatively wider tail end through the sewn in place label, placing a removable, reusable device for securing a necktie in place longitudinally through the sewn in place label, looping the device around the sewn in place label such that the end with the sewn button hole passes through the circular hole in the other end and the end with the button hole is attached to the most proximate button on the users shirt. It can thus be seen that the present invention provides a necktie restraint and method which is removable, reusable, and infinitely adjustable to suit any positioning of the necktie and shirt buttons.

These features and advantages of the present invention as well as others will be more fully understood when the following description is read in light of the accompanying drawings.

IN THE DRAWINGS

FIG. 1 is a perspective view of a typical necktie shown with tail turned about 180°.

FIG. 2 is a perspective view of the necktie showing attachment by the device to a shirt button.

FIG. 3 is a front view of the device.

DESCRIPTION OF THE PREFERRED EMBODIMENT

In FIG. 1 there is illustrated a typical shirt 10 having a collar portion 12 and a plurality of spaced apart buttons 14. The typical necktie 16 has a middle portion 18 wrapped about the collar 12 and normally hidden from view by the turned down collar 12. The necktie 16 is knotted in any suitable well known manner. The necktie 16 thus forms two elongated tail portions 20, 22, the first of which comprises a relatively wide tail portion 20 and the second of which comprises a relatively narrow tail portion 22. Typically, the relatively wide tail portion 20 is usually longer than the relatively narrow tail portion 22 when the necktie 16 is properly knotted. The relatively wide tail portion 20 includes on the backside thereof a transversely extending strip of fabric 24 ordinarily positioned at about four to five inches from the terminal end. This fabric strip 24 carries indicia such as trade names, trademarks, etc. This fabric strip 24 is sewn between opposite sides of the relatively wide tail portion 20 of the necktie 16 and forms a middle portion into which there can be inserted the relatively narrow tail portion 22. The relatively narrow tail portion 22 is inserted in the direction of its length behind the fabric strip 24.

FIGS. 2 and 3 show a necktie restraint 26 comprising a longitudinal strip of flexible material 32 with a sewn button hole 28 on one end and a circular hole 30 on the other end. In operation, the wearer knots the necktie 16 in any suitable well known manner, thereby establishing the positioning of the relatively wide tail portion 20 and relatively narrow tail portion 22 with respect to each other. It will be understood that the necktie 16 can be knotted in an infinite number of configurations resulting in wide variances in the positioning of the relatively wide and narrow tail portions 20, 22. Once the necktie 16 is knotted, the relatively narrow tail portion 22 is inserted and passed through a transverse strip of fabric 24 such as a sewn in place label extending across the back of the relatively wide tail portion 20 of the necktie 16. The necktie restraint device 26 is then inserted through the transverse strip of fabric 24 and the end of the necktie restraint with the sewn button hole 28 is in turn passed through the circular hole 30 in the opposite end of the necktie restraint 26. The necktie restraint 26 is buttoned onto a proximate button 14 on the shirt 10 thereby securing the lower portion of the necktie 16 yet allowing reasonable movement with respect to the shirt 10.

In preferred form, the length of the necktie restraint 26 is from two and one-half to three inches, which allows for attachment to buttons 14 on a shirt 10 with typical button spacing.

It can thus be seen that the present invention provides a necktie restraint which infinitely suits any positioning of the necktie and shirt buttons. Normal torso movements of the wearer which typically draw the necktie vertically do not dislodge the necktie particularly the knotted portion from its positioned site.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A method for securing a necktie on a shirt having a plurality of spaced apart buttons comprising the steps of:

providing a necktie having a relatively wide tail with a sewn in place label and a relatively narrow tail being knotted in any suitable well known manner;

placing the relatively narrow tail through the sewn in place label on the relatively wide tail;

placing a removable, reusable necktie restraint having a longitudinal strip of flexible material, a sewn button hole on one end and a circular hole on the other end longitudinally through the sewn in place label;

looping the removable, device around the sewn in place label such that the end with the sewn button hole passes through the circular hole on the other end; and attaching the end with the button hole to a most proximate button on the shirt having a plurality of spaced apart buttons.

* * * * *